US012798742B2

(12) United States Patent
Reiners

(10) Patent No.: US 12,798,742 B2
(45) Date of Patent: Nov. 17, 2026

(54) KITE LAUNCH-LAND SYSTEM

(71) Applicant: OCEANERGY INNOVATION GMBH, Stuttgart (DE)

(72) Inventor: Wolfram Johannes Bernd Reiners, Stuttgart (DE)

(73) Assignee: OCEANERGY INNOVATION GMBH, Stuttgart (DE)

( * ) Notice: Subject to any disclaimer, the term of this patent is extended or adjusted under 35 U.S.C. 154(b) by 18 days.

(21) Appl. No.: 18/718,233

(22) PCT Filed: Dec. 9, 2022

(86) PCT No.: PCT/IB2022/061961
§ 371 (c)(1),
(2) Date: Jun. 10, 2024

(87) PCT Pub. No.: WO2023/105473
PCT Pub. Date: Jun. 15, 2023

(65) Prior Publication Data

US 2025/0083786 A1 Mar. 13, 2025

(30) Foreign Application Priority Data

Dec. 10, 2021 (ZA) ..... 2021/10238

(51) Int. Cl.
*B63H 9/072* (2020.01)

(52) U.S. Cl.
CPC ..... *B63H 9/072* (2020.02)

(58) Field of Classification Search
CPC ... B63H 8/00; B63H 8/10; B63H 8/16; B63H 8/20; B63H 8/21; B63H 8/23; B63H 8/24; B63H 8/25; B63H 8/40; B63H 8/50; B63H 8/52; B63H 8/54; B63H 9/06; B63H 9/069; B63H 9/071; B63H 9/072; B63H 9/10;
(Continued)

(56) References Cited

U.S. PATENT DOCUMENTS 4,821,976 A * 4/1989 Nakashima ..... A63H 27/002 244/155 A
5,024,401 A * 6/1991 Nakashima ..... A63H 27/002 242/395

(Continued)

FOREIGN PATENT DOCUMENTS

CN 119240461 A * 1/2025 ..... B64F 3/02
EP 3747756 A1 12/2020

(Continued)

OTHER PUBLICATIONS

International Search Report and Written Opinion dated Apr. 13, 2023 for corresponding PCT/IB2022/061961 (13 pps).

*Primary Examiner* — Joshua E Rodden
(74) *Attorney, Agent, or Firm* — Kenner Renner; Arthur M. Reginelli

(57) ABSTRACT

A kite launch-land system which includes a base, one or more kite connecting lines extending from the base for interconnecting a kite and the base, and, an organising arrangement arranged about the base for manipulating/organising the one or more kite connecting lines during launch and/or land of the kite for effectively controlling the kite by inhibiting slack in the one or more kite connecting lines by straightening and/or stretching out and/or tensioning at least a portion of the one or more kite connecting lines.

20 Claims, 13 Drawing Sheets

(58) Field of Classification Search
CPC .. B63H 9/1021; B63H 9/1078; B63H 9/1085; B63H 2009/088; B63H 2009/105; B64C 31/06; B64C 2031/065; B64F 3/00; B64F 3/02
USPC ..... 244/155 A
See application file for complete search history.

(56) References Cited

U.S. PATENT DOCUMENTS

| | | | | | |
|---|---|---|---|---|---|
| 6,003,457 | A * | 12/1999 | Chatelain | B63H 9/069 | 114/102.16 |
| 6,085,679 | A * | 7/2000 | Tiesler | B63H 9/1078 | 114/98 |
| 11,440,680 | B2 * | 9/2022 | Talke | B66D 1/7489 | |
| 11,673,691 | B2 * | 6/2023 | Reiners | B64C 31/06 | 701/3 |
| 12,312,051 | B2 * | 5/2025 | Jalala | B63B 39/06 | |
| 2004/0035345 | A1 * | 2/2004 | Lundgren | B63H 9/069 | 114/102.18 |
| 2010/0032949 | A1 * | 2/2010 | Varrichio | F03D 5/00 | 290/55 |
| 2019/0071175 | A1 * | 3/2019 | Chafe | B64C 31/06 | |
| 2020/0377229 | A1 | 12/2020 | Reiners | | |
| 2021/0253209 | A1 | 8/2021 | Arrouy et al. | | |
| 2021/0253210 | A1 * | 8/2021 | Arrouy | B63H 9/072 | |
| 2022/0128027 | A1 * | 4/2022 | Reiners | B64C 31/06 | |

FOREIGN PATENT DOCUMENTS

| | | | | |
|---|---|---|---|---|
| FR | 3082185 | A1 | 12/2019 | |
| WO | WO-0218202 | A1 * | 3/2002 | B63H 9/069 |
| WO | WO-2013147600 | A2 * | 10/2013 | B64C 31/06 |
| WO | WO-2013164446 | A1 * | 11/2013 | B63H 9/072 |
| WO | WO-2015013728 | A2 * | 1/2015 | B63H 9/071 |
| WO | 2020183313 | A1 | 9/2020 | |

* cited by examiner

KITE LAUNCH-LAND SYSTEM

TECHNICAL FIELD OF THE INVENTION

This invention relates to a system for launching and landing a kite, more particularly a system for organizing the kite connecting lines and/or bridles during launch and land of the kite.

BACKGROUND TO THE INVENTION

A great wealth of kite systems or apparatuses have been suggested with the aim to extract energy from the wind, either mechanical for traction, or to drive one or more generator(s) to gain green electricity.

Safe and process capable launching and landing of these kites is essential for these systems. A number of systems have been suggested. Some of these use a separate launch kite, which lifts the main kite into the air. Others use drone-like structures for this task, i.e. driven propellers. Mostly, however, launch/land masts are used to perform this function. They serve mainly two purposes. Firstly, before the launch, these masts (or the aforementioned other lift structures) hold the kite into the wind, above the ground, where wind is more stable, less turbulent and slightly stronger. Secondly, the mast(s) serve(s) the purpose to stretch out the bridle system of the kite, on which the kite is suspended. In this way, the kite's bridles are fully extended, and the kite becomes steerable by means of its traction ropes, or in cases where there is a kite control system suspended below the kite (a "steering gondola"), mostly at the end of the bridle system, where the kite traction rope(s) terminate, the kite control system is lifted into the air, hanging from the mast(s), and the bridles are thus stretched out, so that the kite can be steered.

Sometimes these masts can be swung or rotated, sometime even catapult-like, with the aim to create apparent wind, or with the aim to build up centrifugal forces. Yet other systems even foresee to create additional artificial wind with propellers near the mast(s) to help launch the kite.

One downside of mast systems is associated with scalability. Big high-performance kites often require long bridle systems, which in turn require long/high masts for launch or landing. As a rule of thumb, an efficient bridle system is about as long as the kite's wing span, and in such cases the mast length limits the kite's size. If the kite is launched on sea, from the deck of a ship or a buoy, the movement of the mast(s)' end(s) increases with the length of the mast(s), which poses further limits.

Masts pose further downsides, during landing, when the kite needs to be "caught by the mast", before the kite control unit touches the ground or before the bridles become slack and the kite is therefore not steerable any more. These issues during landing also pertain to lift kites or drone like systems, i.e. to grab the kite and suspend it from the lift kite or drone(s), unless the drones are integrated into the kite. In such cases, however, there are of course negative effects of weight.

It is the objective of the invention to overcome such problems and disadvantages associated with known systems. The present invention attempts to eliminate these technical problems. In particular, the inventor believes that the present invention allows to launch much larger kites, than with previously known launch/land systems, and to land them safely back on the ground or on the deck of a watercraft. This leads to much more power or energy generation of such a kite system, regardless of whether the aim is to produce propulsion power, or electrical power or energy output, or ultimately a stored form of energy, such as green hydrogen or derivate e-fuels.

Further, the invention presents a system to store a kite, while on the ground.

For the purpose of this specification, we use the term "kite" shall mean to include a wing (the kite's "canopy"), manufactured mainly from semi-rigid, soft or inflatable structures, a sail, an airfoil, a kind of flexible wing profile, a paraglider, a tethered wing, or any other similar wind engagement element connected to the ground by one line or by a plurality of lines and/or bridles, and capable of being lifted aerodynamically by the wind. The singular version "kite" shall also imply a plurality of such kites. The kite may be tethered to a flying kite control unit (a "control gondola"), or a base station on the ground (the "ground station"), on a vehicle, on a swimming platform, or on the deck of a ship, and/or to a generator(s) located in such a ground station, by any form of kite connecting line(s), cable(s) or rope(s). We will refer to the latter as "kite connecting line(s)" or short as "line(s)".

Bridles are extensions to the kite connecting lines, interconnecting the kite ("the canopy") and the kite connecting lines (which may include a gondola), often in a forked structure. Bridles may contain pulleys ("mixers").

SUMMARY OF INVENTION

According to an aspect of the invention there is provided a kite launch-land system which includes:

- a base;
- one or more kite connecting lines extending from the base for interconnecting a kite and the base; and
- an organising arrangement arranged about the base for manipulating/organising the one or more kite connecting lines during launch and/or land of the kite for effectively controlling the kite by inhibiting slack in the one or more kite connecting lines.

The one or more kite connecting lines may include bridles, or any suitable connection interconnecting the kite and the base.

The one or more kite connecting lines may contain pulley arrangements, operatively interconnecting the one or more kite connecting lines.

The base may take the form of a ground station.

The base may include one or more winches, for winding up one or more kite connecting lines.

A kite control system may be located in between the base and the kite.

The kite control system may consist of one, two or more components, and may function as an organising arrangement, during launch/landing, when located near the base.

Alternatively, the base may take the form of a kite control system for manipulating the length aspect of the one or more kite connecting lines.

The organising arrangement may include a plurality of organisers, which when engaged with one or more kite connecting lines, inhibit slack of at least a portion of the one or more kite connecting lines by translational, arcuate or rotational displacement of the organisers relative the one or more kite connecting lines.

The organising arrangement may include a plurality of organisers, which when engaged with one or more kite connecting lines, can prevent slack of at least a portion of the one or more kite connecting lines by translational or arcuate or rotational displacement of at least two of the organisers relative one another.

The organising arrangement may include a plurality of organisers, which when engaged with one or more kite connecting lines, can pull in or release out of at least a portion of the one or more kite connecting lines by translational or arcuate or rotational displacement of at least two of the organisers relative one another.

The translational or arcuate or rotational displacement of at least two of the organisers relative one another may result in organising, i.e. straightening or stretching out or tensioning or rolling up, a portion of the one or more kite connecting lines so that the kite remains/becomes steerable.

The translational or arcuate or rotational displacement of at least two of the organisers relative one another may result in pulling in/releasing out at least a portion of the one or more kite connecting lines so that the distance between the organisers and kite decreases/increases, and therefore the distance between the base and the kite.

The organising arrangement may include a plurality of organisers operable independently from one another.

The organisers may take the form of a plurality of frame like elements slidably arranged about the base.

The organisers may take the form of at least one frame like element pivotally arranged about the base.

In use, the one or more kite connecting lines are arranged in engagement with the frame type elements and whereby linear and/or pivotal displacement of one frame type element independently from another results in straightening of the one or more kite connecting lines extending between the frame type elements.

The organisers may take the form of a set of engagement formations positioned opposed one another and whereby when in use, twisting/rotation of the engagement formations results in straightening of or tensioning of or stretching out the one or more kite connecting lines.

Each of the set of engagement formations may take the form of a plurality rods, more typically a pair of rods, arranged in a spaced apart manner and mounted onto a rotatable arm.

In this form of the invention the organisers may act in sync with one another to allow shortening/lengthening of the one or more kite connecting lines.

In this form of the invention the organisers or engagement formations may act dependently of one another to allow for coiling up of the one or more kite connecting line(s).

In another form of the invention the rotatable engagement formations may extend from an arm suspended pivotably for orienting the sets of engagement formation towards and away from one another, respectively.

The organising arrangement may include a plurality of organisers operable dependently from one another.

The organising arrangement may include one or more sets of organisers, operable dependently from one another in a rotatory movement within a set.

The organising arrangement may prevent slack of at least a portion of the one or more kite connecting lines by organising or straightening or stretching or tensioning it between organisers.

In use, the one or more kite connecting lines may be arranged in operative engagement with the plurality of organisers and whereby straightening of the one or more kite connecting lines is facilitated by displacement of one organiser relative the other.

The organising arrangement may be configured so that organising and/or manipulating and/or controlling of the one or more kite connecting lines is facilitated by rotational and/or lateral and/or translational and/or transversal displacement of one organiser relative another.

The organising arrangement may be configured so that the organising of the one or more kite connecting lines is established by translational linear movement of one organiser relative another.

The organising arrangement may be configured so that organising of the one or more kite connecting lines is achieved by arcuate translational displacement of the organisers.

The organising arrangement may be configured so that organising of the one or more kite connecting lines is achieved by rotation of at least one organiser.

The organising arrangement may be configured so that organising of the one or more kite connecting lines is achieved by rotation of at least one organiser.

The organising arrangement may be configured so that organising of the one or more kite connecting lines is achieved by rotation of at least two engagement formations or imaginary lines defined about on a structure around each other.

The organising arrangement may be configured so that organising of the one or more kite connecting lines is achieved by rotation of the organiser in direction transversally the chord axis of the kite.

The organising arrangement may be configured so that organising of the one or more kite connecting lines is achieved by rotation of at least one organiser in direction substantially parallel the chord direction of the kite.

The organising arrangement may be configured so that straightening/tensioning/organising of the one or more kite connecting lines is achieved by increasing the space defined between a pair of organisers where each of the organisers are operatively engaged with each of the kite connecting lines.

The organising arrangement may take the form of one or more cylinders for winding up and release of at least a portion of the one or more kite connecting lines.

In this embodiment the organizers are defined as points or imaginary lines, which are located on a cylinder-like structure (e.g. a beam, a rod, a pole, a cylinder, a drum, or the like), and the distance or circumference between these can straighten or wind up portions of the one or more kite connecting lines between these two points or imaginary lines.

The cylinders may take the form of cylinder-like shapes, such as a polygon pole, or a square bar, or a triangular-shaped bar, or a two/multi-rods decoiler.

The one or more kite connecting lines may be positioned outer the cylinder-like structures.

Rotating organisers may rotate at differential speeds to control the flight of the kite during launch and/or landing.

A rotating organiser may be characterized by rolling up/winding up the one or more kite connecting lines extending from the kite canopy, while at the same time rolling up/winding up one or more kite connecting lines extending from the kite control system, while the kite control system may wind down the one or more kite connecting lines at the same time and at a similar speed, or vice versa.

The organising arrangement may include a plurality of arms displaceably arranged relative one another for when in use, increasing the distance between them, and thereby the stability of the kite's flight during launch and/or landing.

The organising arrangement may include a plurality of arms, each holding/suspending an organising arrangement or an organiser, which can be displaced relative one another for when in use, increasing the distance between them, and thereby the distance between the left-side and right-side of the one or more kite connecting lines from each other, and thereby the stability of the kite's flight during launch or landing.

The organising arrangement may include a plurality of arms, which may be positioned in a manner that the organisers do not touch the one or more kite connecting lines, and are moveable to touch and interconnect with the one or more kite connecting lines.

The organisers may include a catch mechanism for operatively engaging the organiser with a portion of the one or more kite connecting lines.

The cylinder may include a catch mechanism for operatively engaging the cylinder with a portion of the one or more kite connecting lines.

The catch mechanism may take the form of a slot, groove, hook or any other similar engagement formation.

The catch mechanism may be equipped with sensors and/or a locking system, which may be remotely controlled.

The organising arrangement may include one or more reefing frames, arranged around organisers, to reef the one or more kite connecting lines.

The kite launch and land system may further include one or more support masts for supporting the kite during launch and/or landing.

The kite launch and land system may further include one or more drones for supporting the kite during launch and/or landing.

The kite launch and land system may further include one or more airflow optimisers, like wind guides, spoilers, or fans, for supporting the kite during launch and/or landing.

The kite launch and land system may wind up also parts of the kite.

A portion of the launch and land system, including the organisers, may be detachable from the remaining portions, to remove the rolled-up kite with a portion of the one or more kite connecting lines and replace it with a new kite, including its lines and bridles.

Typically, the one or more kite connecting lines extend from the base, which optionally includes one or more winches per kite connecting line, towards the organising arrangement, and away from the organising arrangement towards the kite.

According to another aspect of the invention there is provided a kite launch-land system which includes:

a base;

one or more kite connecting lines extending from the base for interconnecting a kite and the base; and an organising arrangement arranged about the base for manipulating and/or organising the one or more kite connecting lines during launch and/or land of the kite, to pull in/release out at least a portion of the kite connecting lines, so that the distance between the organising arrangement and kite decreases/increases, and therefore the distance between the base and the kite.

BRIEF DESCRIPTION OF THE DRAWINGS

The invention will now be described by way of the following, non-limiting example with reference to the accompanying drawings.

In the drawings.

DETAILED DESCRIPTION OF THE DRAWINGS

Figure 1:
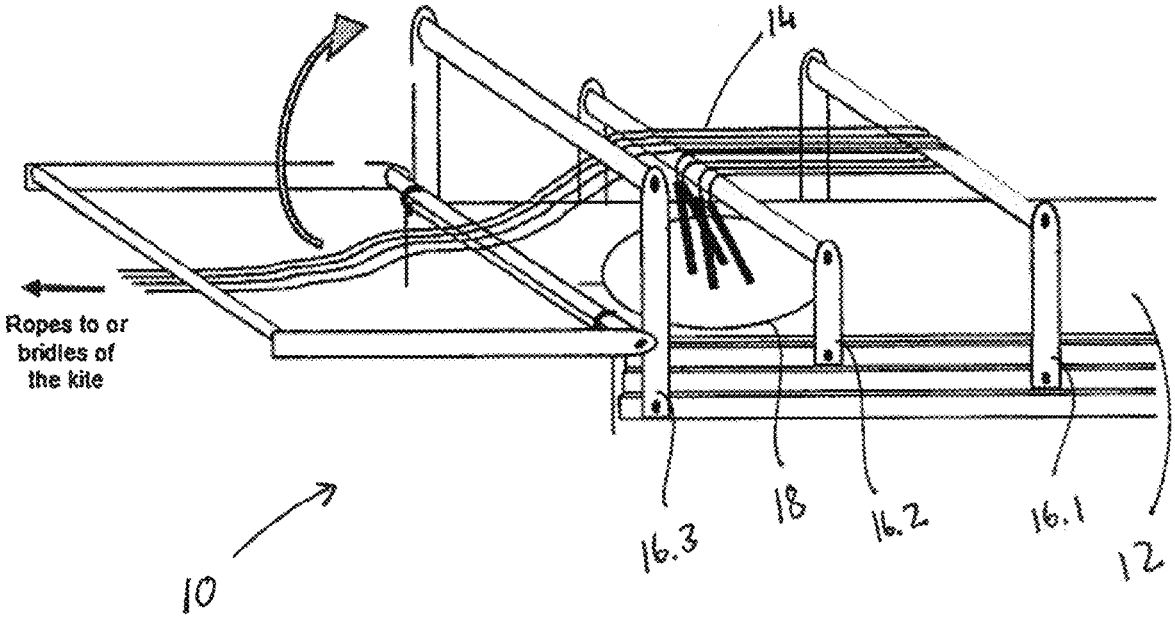
FIGS. 1 to 4 are schematics of a first embodiment.

Referring now to the drawings, reference number 10 generally refers to a first embodiment of the kite launch and land system while reference numerals 110, 210 and 310 refers to second, third and fourth embodiments, respectively, of the kite launch and land system.

FIGS. 1 to 4 depict a first embodiment of the kite launch and land system 10 which includes a base 12, one or more kite connecting lines 14 extending from the base 12 for interconnecting a kite (not shown) and the base 12 and an organising arrangement taking the form of a plurality of frame type elements 16.1, 16.2, 16.3 and 16.4 extending from the base 12 for manipulating and/or organising the one or more kite connecting lines 14 during launch and/or land of the kite, in a manner so to prevent slack of at least a portion of at least one of the kite connecting lines 14.

The frame type elements 16.1, 16.2 and 16.3 are operable independently from one another and slidably mounted onto base 12. The frame type element 16.4 can also be pivotally mounted onto and extending from base 12 and can take form of a commonly known mast for launching a kite of the kind.

FIGS. 1 to 4 depict the different orientation of the frame type elements 16.1, 16.2, 16.3 and 16.4 relative one another to establish the launching of the kite.

In FIG. 1 shows prior to launch, the kite connecting lines 14 arranged in engagement with the frame type elements 16.1, 16.2, 16.3 and 16.4 and whereby linear displacement of frame type elements 16.1, 16.2 and 16.3 and pivotal displacement of frame type element 16.4 independently from one another results in straightening of the one or more kite connecting lines 14 extending therein between.

Figure 2:
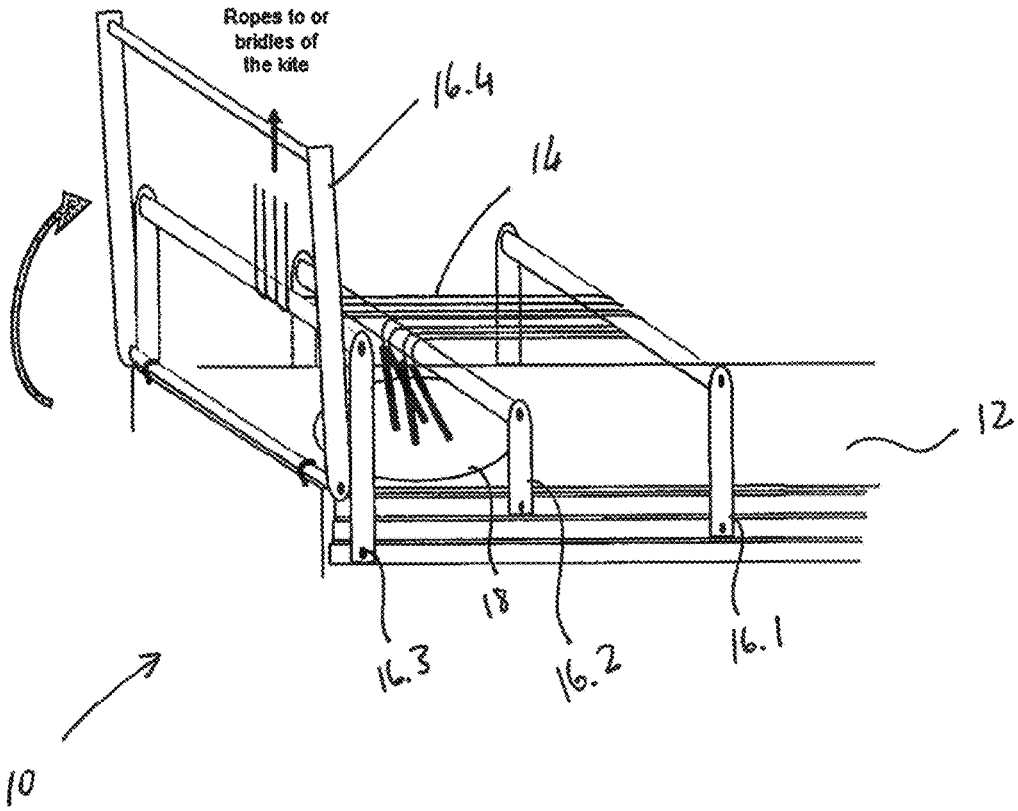

FIG. 2 depicts the orientation of the frame like element 16.4 swung upward, to bring the kite (not shown) into position to launch, or to catch the kite during landing.

The one or more kite connecting lines or bridles 14 are stretched out by the frame like elements 16.1, 16.2 and 16.3 and therefore kept under tension, so that the kite can be controlled (steered) by kite control system 18.

Figure 3:
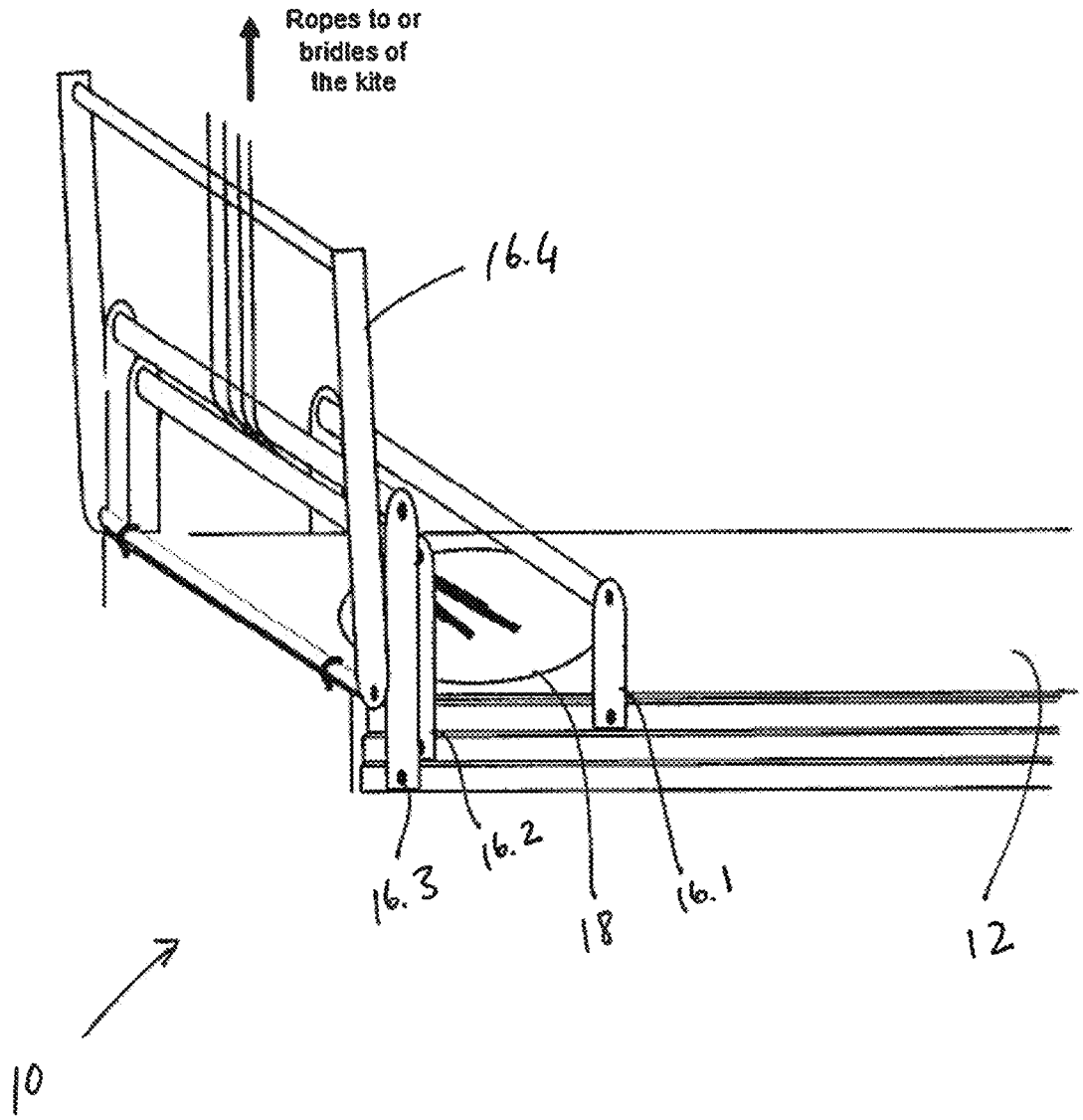

FIG. 3 depicts orientation of frame like element 16.2 displaced in disengagement with kite connecting lines 14. By this, the one or more kite connecting lines 14 leave (or move away from) frame type element 16.1 and are guided over frame type element 16.3.

Figure 4:
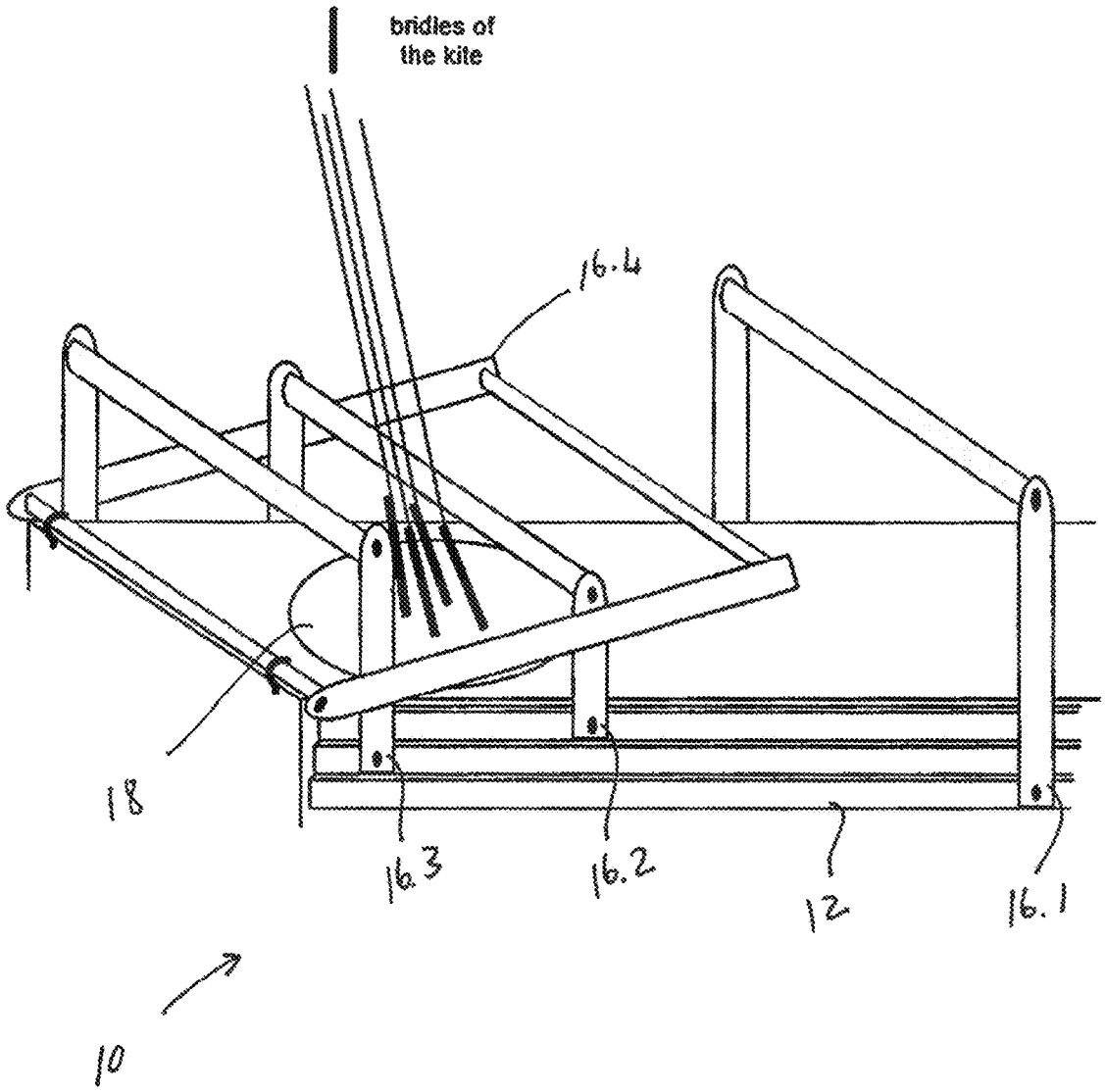

In FIG. 4 frame type element 16.3 is displaced backward, in a translational, linear movement. The kite is fully controlled by the kite control system 18. The one or more kite connecting lines 14 do not touch any of the frame type elements 16.1, 16.2 and 16.3. The frame type element 16.4 is pivoted away and the one or more kite connecting lines (which may include bridles and/or mixers) 14 extend straight away from kite control system 18.

Figure 5:
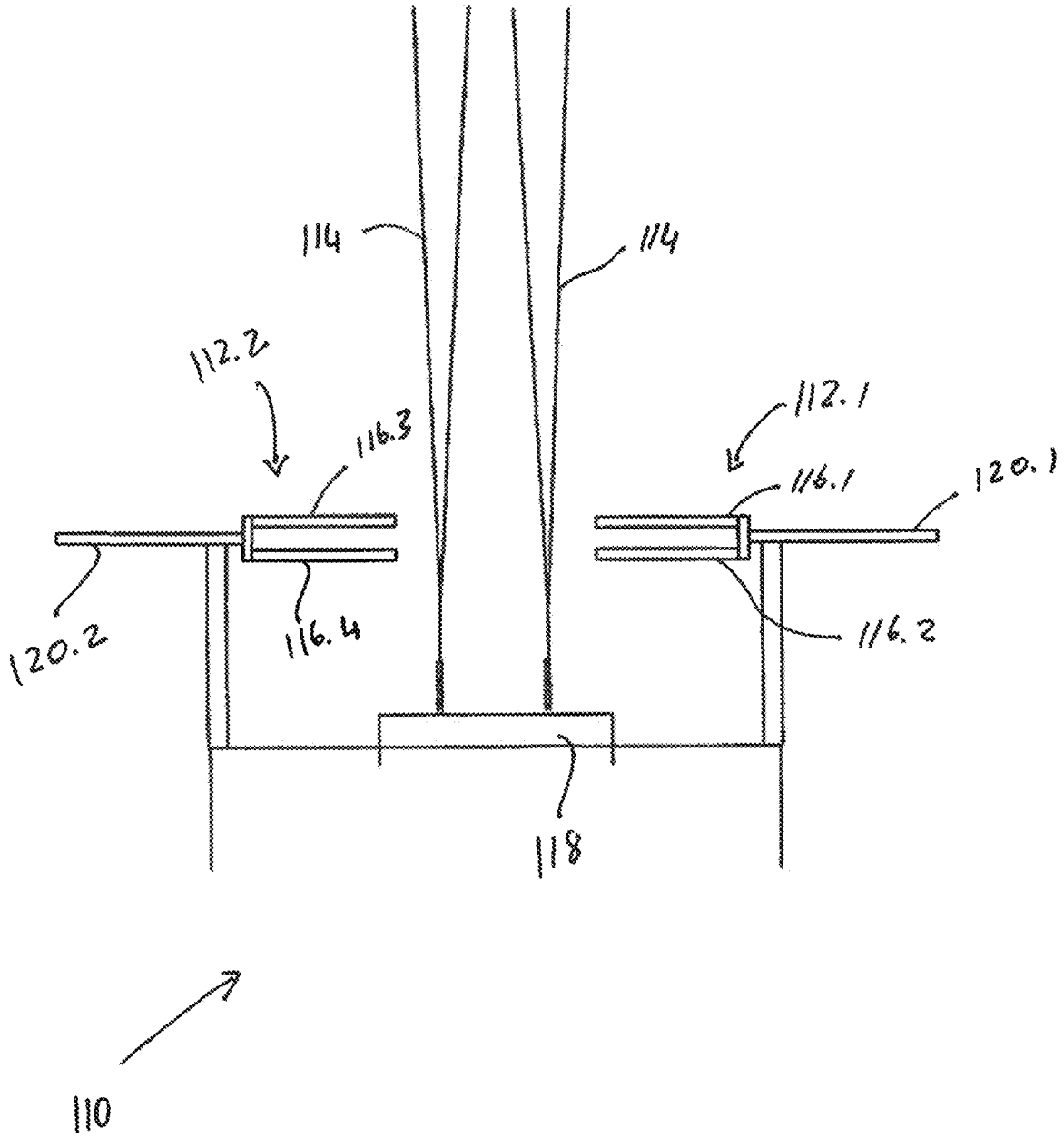
FIGS. 5 to 7 are schematics of a second embodiment.
Figure 6:
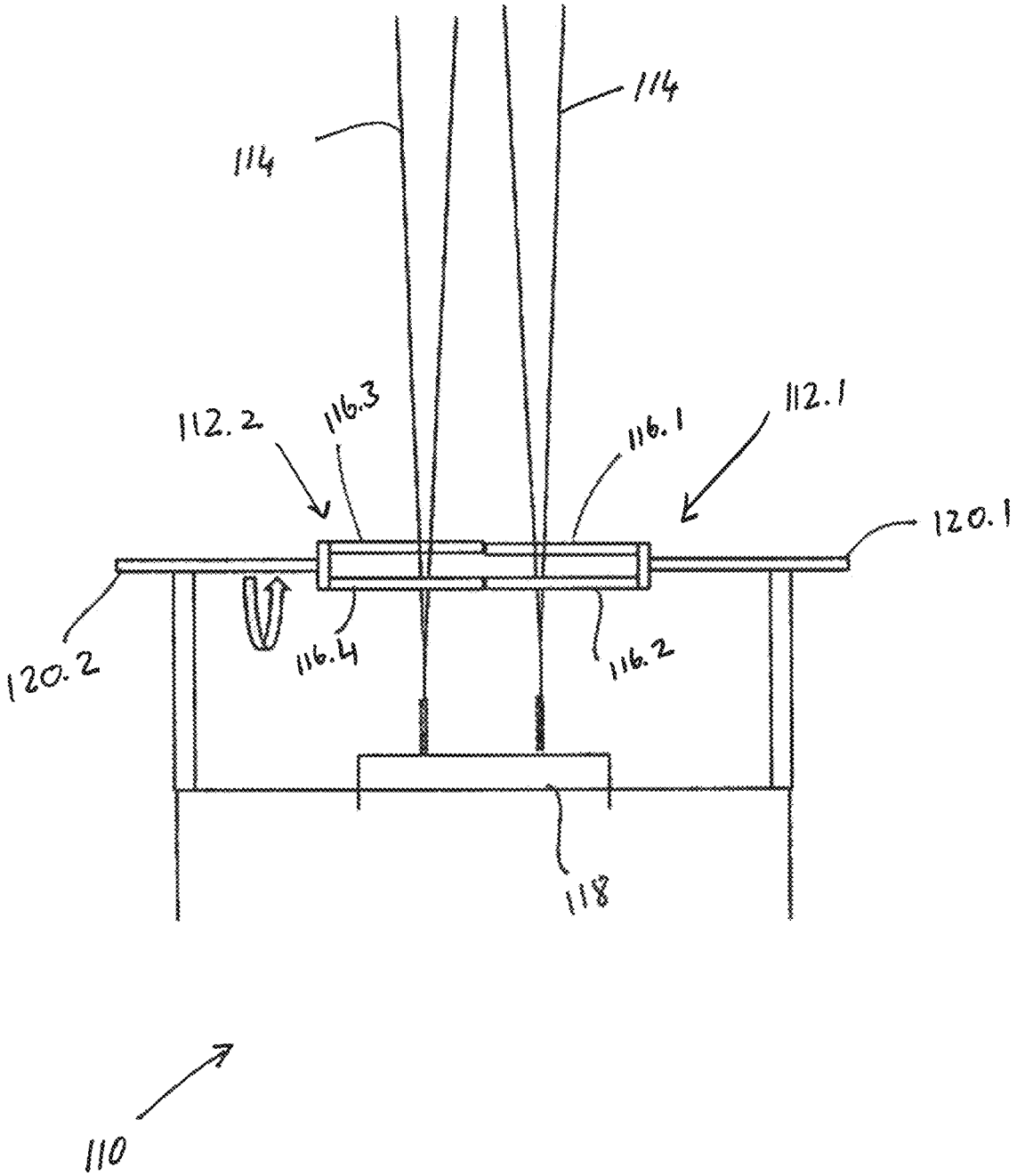
Figure 7:
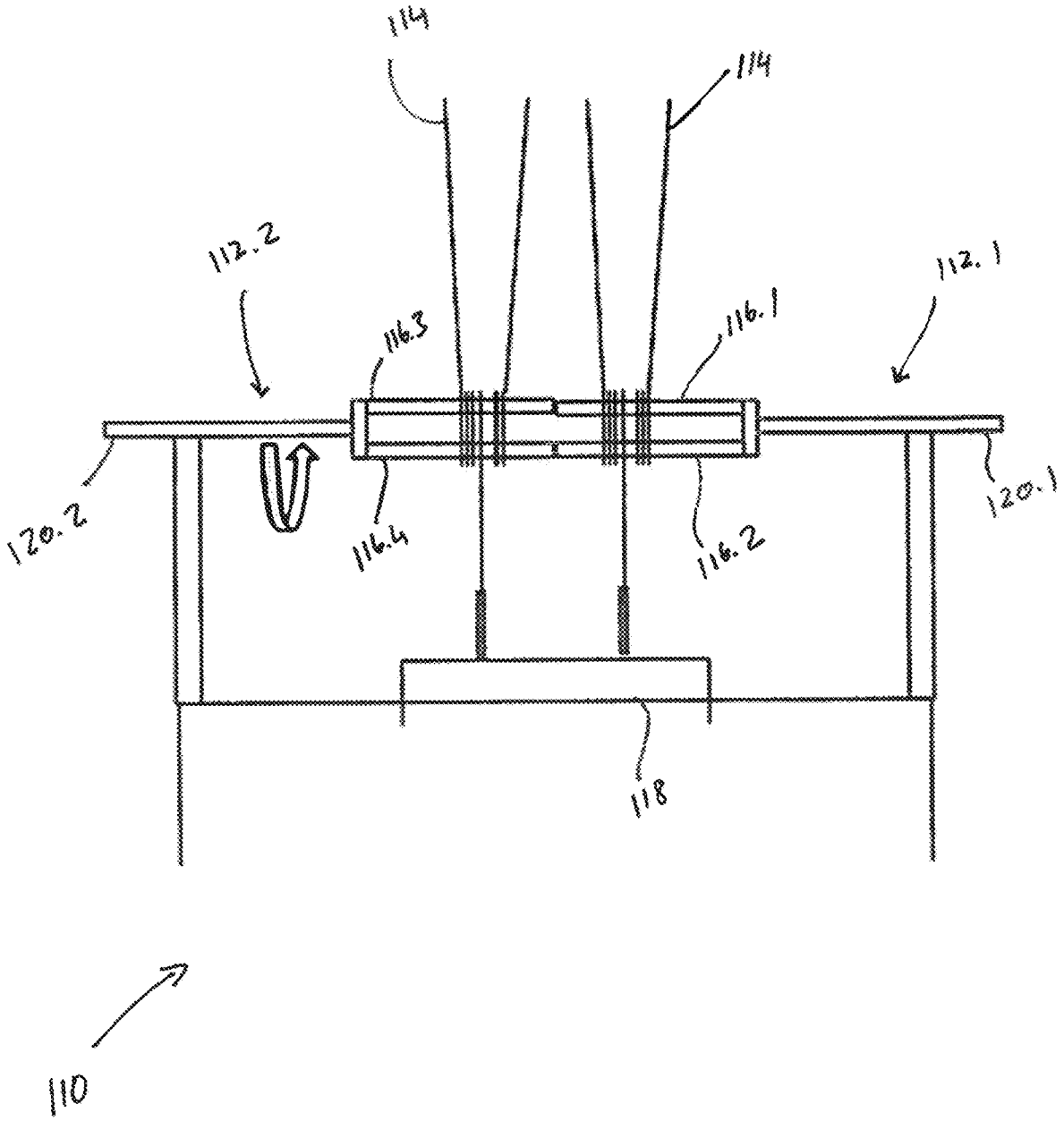

FIGS. 5 to 7 depict a second embodiment 110 of the kite launch and land system.

In this embodiment the organisers take the form of a pair of engagement formations 112 positioned opposed one another and whereby when in use, twisting/rotation of the engagement formations 112 result in winding up of the one or more kite connecting lines 114 and in straightening or stretching out or tensioning of a portion of the one or more kite connecting lines 114, above and/or below the engagement formations 112.

FIG. 5 illustrates the orientation of the kite launch and land system 110 during flight of the kite, FIG. 6 depicts engagement with the one or more kite connecting lines 114 and FIG. 7 illustrates rotation of engagement formations 112.1 and 112.2 to wind or roll up/coil up/wind up the one or more kite connecting lines 114 for landing the kite (and wind down/coil off when launching). The kite connecting lines will bend, be redirected or deflected by this.

When not in use the engagement formations 112.1 and 112.2 can be moved or folded away.

The kite control system 118 controls the kite and can be integrated into the ground station or suspended at the end of the bridles, in flight below the kite (in the air, in a so-called gondola or kite control unit; not shown).

Each of the set of engagement formations 112.1 and 112.2 include a pair of rods 116.1 and 116.2, and, 116.3 and 116.4, respectively, arranged in a spaced apart manner and mounted onto a rotatable arm 120.1 and 120.2.

In this form of the invention the pair of engagement formations 112.1 and 112.2 may act in sync with one another to allow even winding up of the kite connecting lines 114, when in use. They may also act independently of one another, with the aim to steer the kite.

For launch/land of the kite engagement formations 112.1 and 112.2 will be rotated, with a portion of the one or more kite connecting lines 114 or bridles stretched between at least two rods 116.1, 116.2, 116.3 and 116.4.

Either the differential rotational movement of the engagement formations 112.1 and 112.2 controls the flight of the kite, or the kite has sufficient auto-zenith properties, which makes such active control dispensable.

While the engagement formations 112.1 and 112.2 wind up the one or more kite connecting lines 114, the kite control system 118 wind down/release one or more of the one or more kite connecting lines 114.

FIGS. 8 to 13 depict a third embodiment of the kite launch and land system 210 wherein the rotatable engagement formations 212.1 and 212.2 are each mounted about an arm 214.1 and 214.2 which is suspended pivotably, for orienting the engagement formations 212.1 and 212.2 inward, and outward, relative the kite control system 216, away and towards each other.

Figure 8:
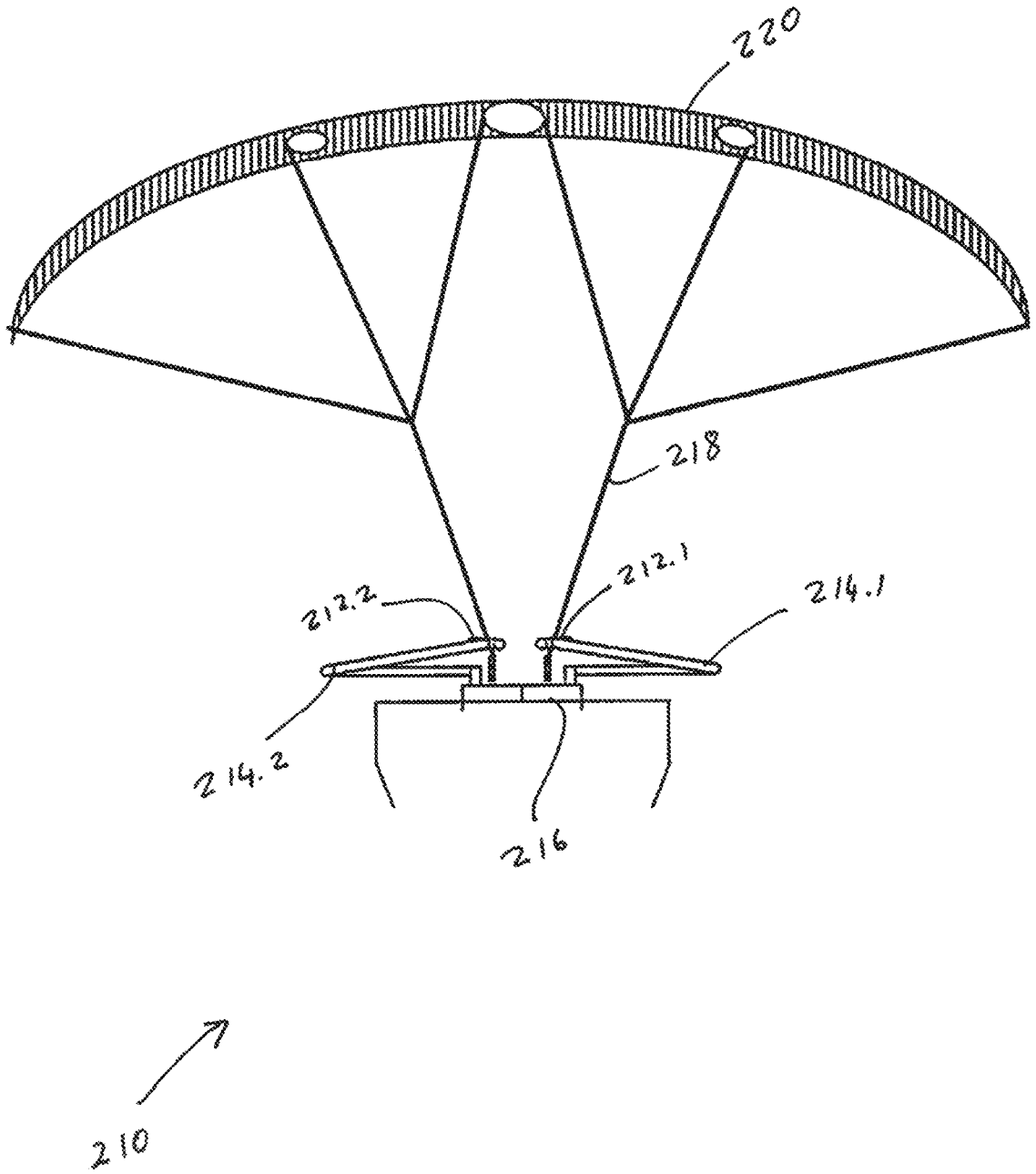
FIGS. 8 to 12 are schematics of a third embodiment.

FIG. 8 depicts the orientation of the engagement formations 212.1 and 212.2 during flight. The kite 220 is attached to the one or more kite connecting lines 218, which are typically bridled (forked) at a portion towards the kite, connecting the kite and the kite control system 216. Depicted are two kite connecting lines and their bridles/forked sections, but other configurations are possible, e.g. four kite connecting lines, or one kite connecting line to a kite control unit ("gondola") suspended below the kite 220, and bridles from this unit to the kite (not shown).

In this instance, the kite control system 216 is located on a watercraft, such as for instance a wind energy harvesting ship, which can produce electricity, by converting the traction force of the kite 220 by means of generators or turbines, and which may use said green electricity on board, or store it in form of green hydrogen or green e-fuels in tanks (not shown).

The engagement formations 212.1 and 212.2 can be moved or folded away, or these may be positioned around the kite connecting lines or bridles 218, typically without touching these.

The kite control system 216 controls the kite (e.g. by manipulating the length aspect of the one or more kite connecting lines; and/or by actuators at the kite, such as rudders or ailerons). The kite control system 216 can be integrated into the ground station or it may be suspended at the lower end of the bridles, in flight below the kite (not shown).

Figure 9:
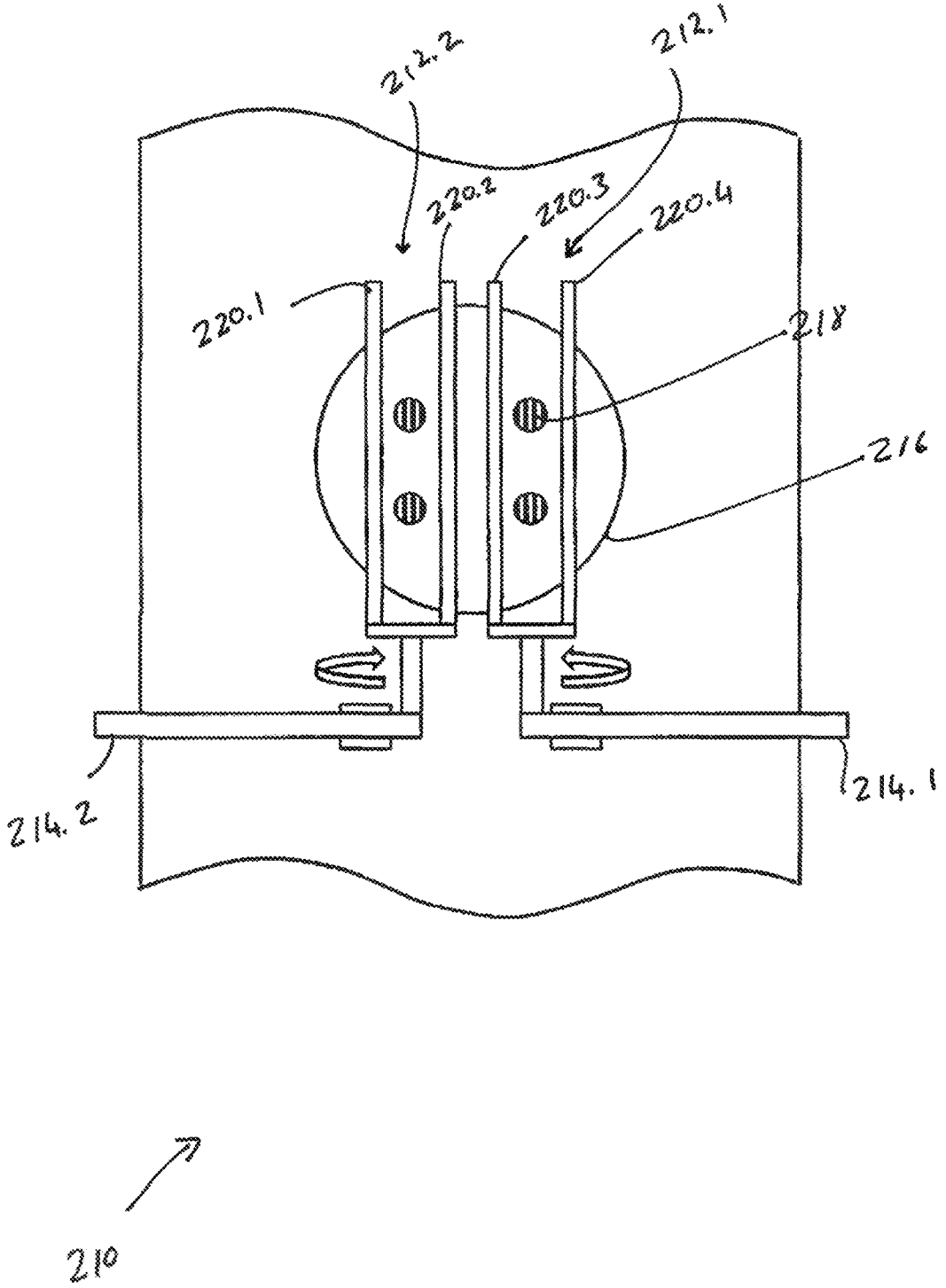

FIG. 9 is a schematic depicting the land and launch system 210 during flight, or before landing, or after launch, as a top view. The one or more kite connecting lines 218, in this instance four lines, are guided through the engagement formations 212.1 and 212.2 each of which is comprised of its own pair of spaced apart rods 220.1 and 220.2, and, 220.3 and 220.4, respectively.

The engagement formations 212.1 and 212.2 can dislocate relative one another (or dislocate or displace against each other) in a rotational movement. This dislocation can stretch out (or tension or straighten) a portion of the one or more kite connecting line(s) or the bridles 218, on which the kite 220 is suspended and wind up a portion of the one or more kite connecting line(s) or the bridles, thereby organising the one or more kite connecting lines 218 as needed to prevent slack, and to keep the kite flying and steerable. While doing do, the engagement formations pull in (land) or release out (launch) a portion of the one or more kite connecting lines, and thereby shorten/lengthen the distance between the engagement formations 212.1 and 212.2 and the kite 220.

It is to be noted that rotational displacement of the engagement formations or organisers does not twist the ropes.

Figure 10:
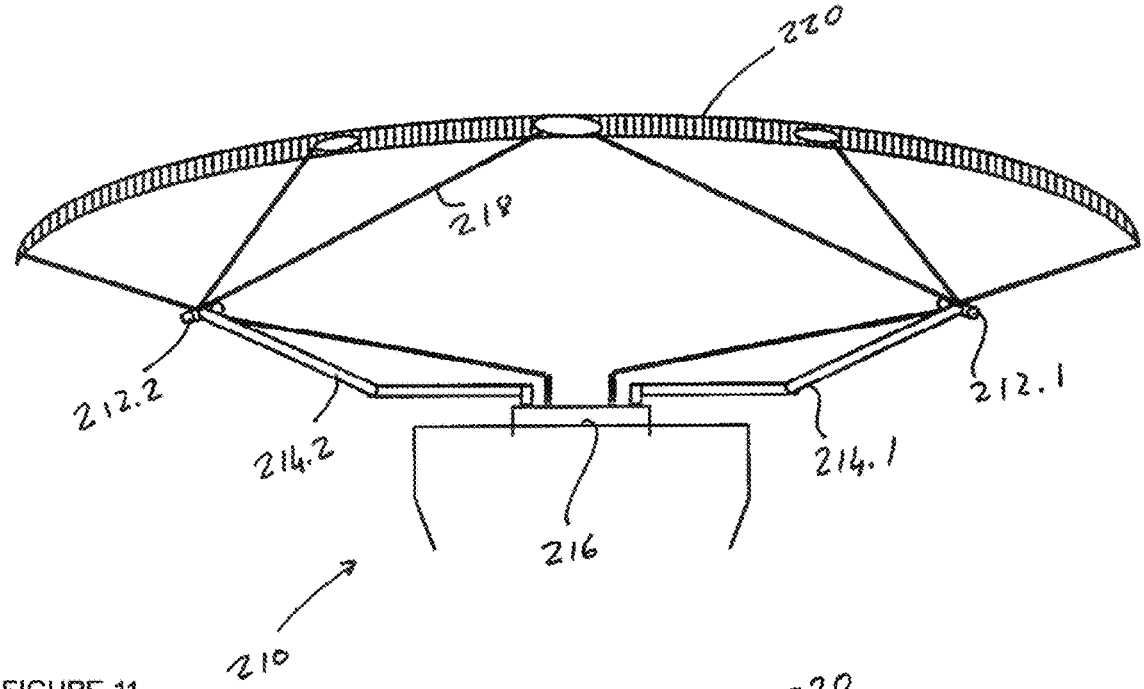

In FIG. 10 the one or more kite connecting lines or bridles 218 emanate and lead from the kite control system 216 to the kite 220, guided through engagement formations 212.1 and 212.2.

Arms 214.1 and 214.2 being pivotable about its "elbow" can be moved outwards, away from each other, to increase the distance between the engagement formations 212.1 and 212.2. The aim for this is to increase stability of the kite's flight during launch or landing, ideally enabling auto-zenith flight of the kite 220 (or getting as close as possible to this ideal).

Pivoting of the pivotable arms 214.1 and 214.2, or linear movement away from each other, can further be facilitated by means of toothed rods, linear cylinders, or by hydraulic cylinders, or any other know method or system (not shown).

The pairs (or triples, quadruples) of engagement formations 212.1 and 212.2 ("sets") may be rotated differentially, to control the flight of the kite 220, or when the kite 220 has sufficient auto-zenith properties, no such control will be necessary.

Kite 220 can also be attached to pivotable frame like elements 16.4 in accordance with the first embodiment of the invention as depicted in FIGS. 1 to 4, or to any other mast, which may be telescopic (linear extension).

The kite connecting lines or bridles 218 lead from the kite control system 216 to the kite 220, and the engagement formations 212.1 and 212.2 can wind up a portion of the one or more kite connecting lines 218 and/or the bridles by the at least two engagement formations 212.1 and 212.2.

Figure 11:
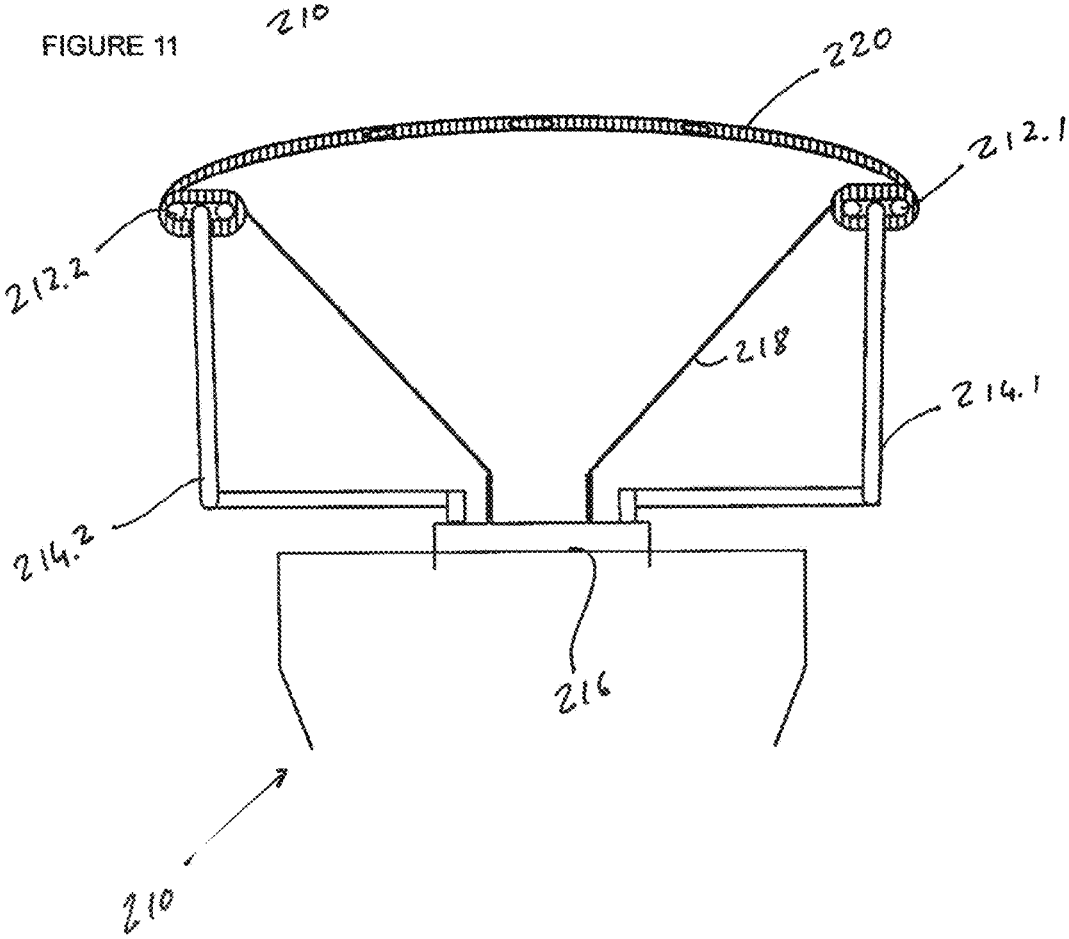

FIG. 11 depicts the kite launch and land system 210 during launch or landing, the engagement formations 212.1 and 212.2 can wind up or wind down the one or more kite connecting lines 218.

Figure 12:
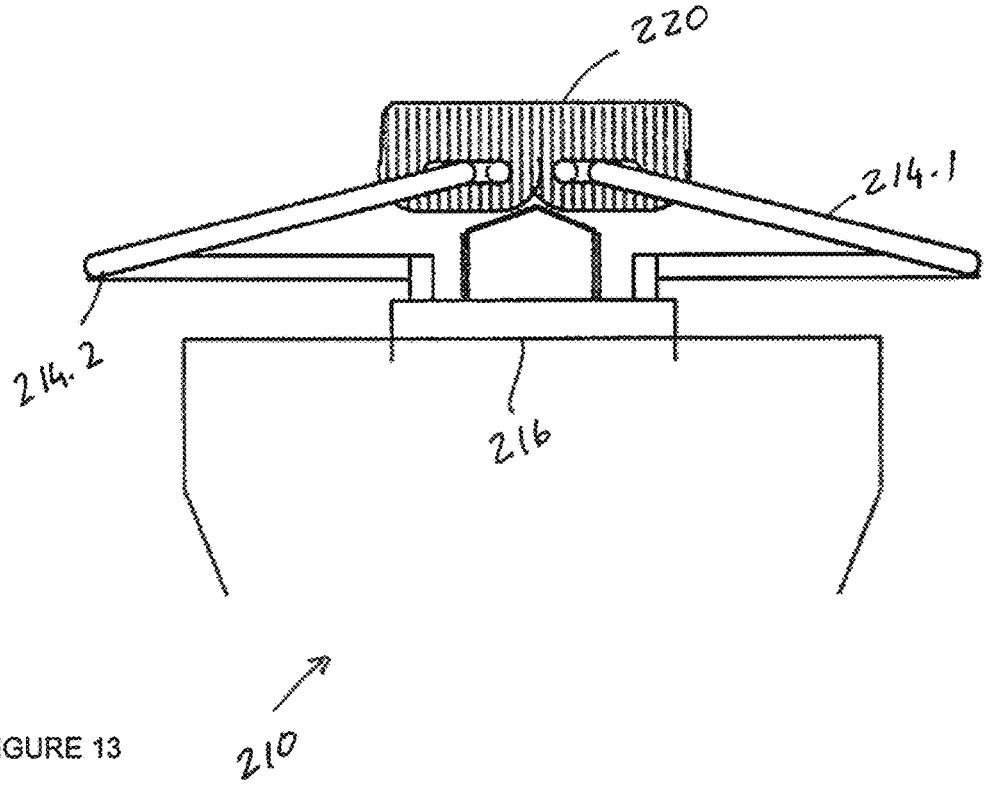
Figure 13:
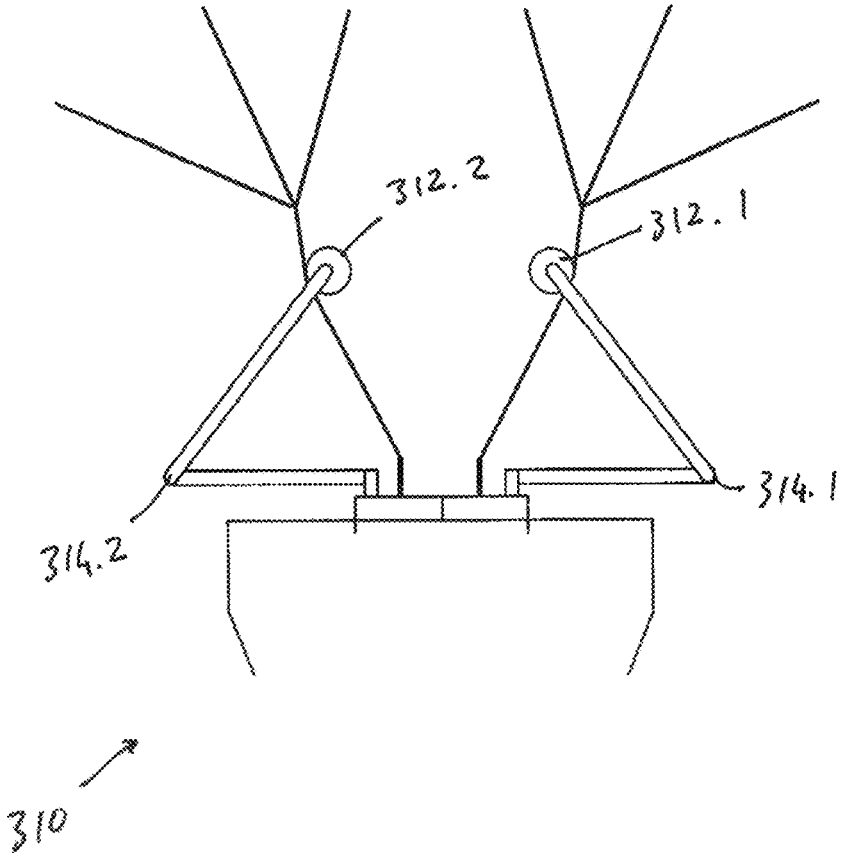
FIGS. 13 and 14 are schematics of a fourth embodiment.
Figure 14:
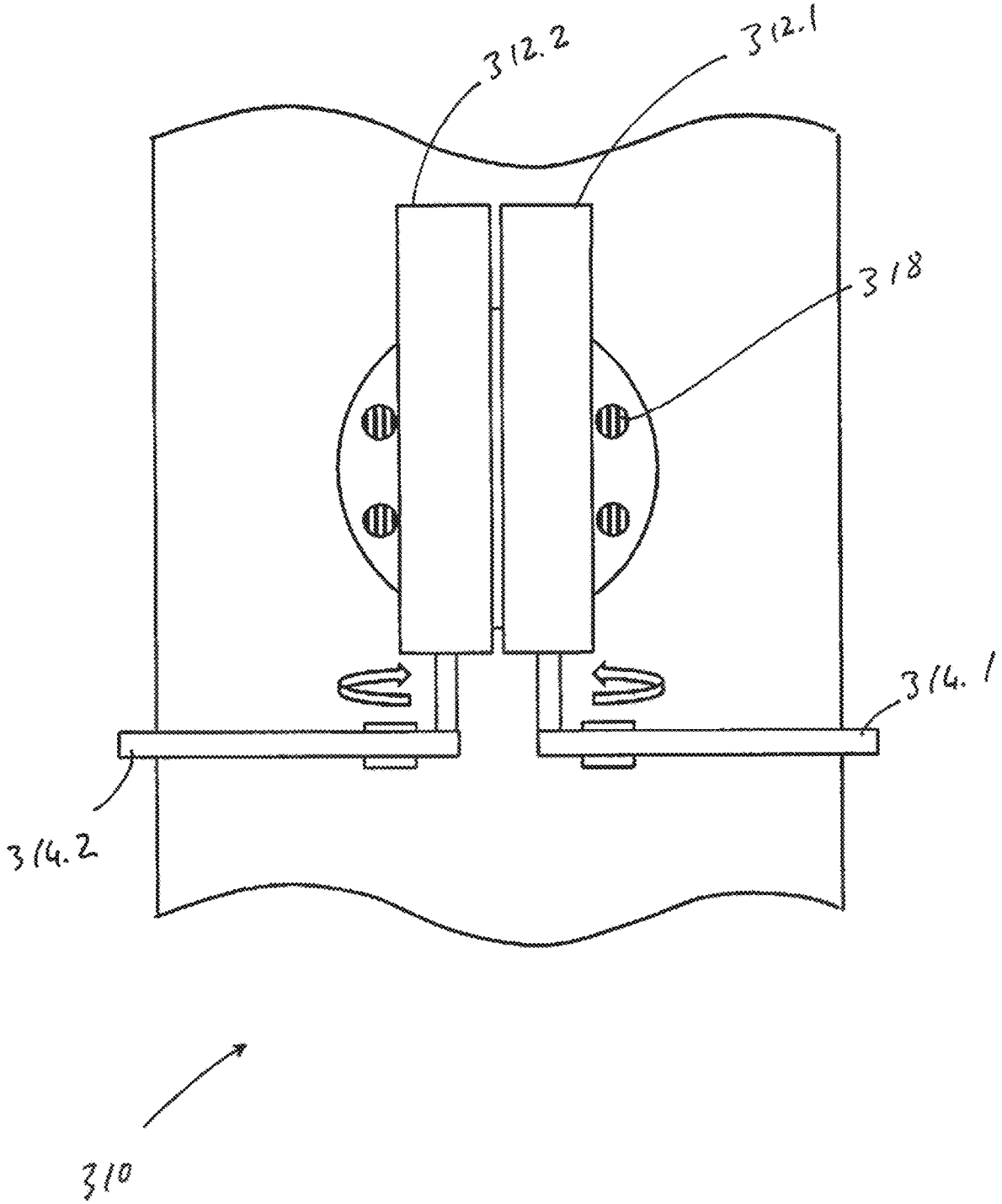

FIG. 12 depicts winding up of the kite connecting lines 218 up to a stage where it is suitable to store the kite 220, or even to disconnect and take off the kite 220 from the kite launch/land system 210, to replace the kite 220, or to connect another kite 220 to the kite launch/land system 210.

The system 210 is now ready to launch the kite, 220 by rotation of the engagement formations 212.1 and 212.2 and therefore by winding down the kite connecting lines 218.

Arms 214.1 and 214.2 can swing outward during this process. The kite 220 can be supported by only the arms 214.1 and 214.2, and/or in addition by pivotable frame like elements 16.4 as depicted in FIG. 1, or by other known forms of launch/land masts, or by drone(s), or pilot kites, connectable to the kite 220. The drone propellers can even be integrated into the kite.

FIGS. 13 to 16 depict a fourth embodiment 310 of the invention wherein the rotatable engagement formations as depicted in FIGS. 8 to 12 are substituted with rotatable cylinders 312.1 and 312.2, mounted about arms 314.1 and 314.2, with arms 314.1 and 314.2 being pivotable about itself to displace the cylinders 312.1 and 312.2 towards, and, away from one another. Again, also linear movements are possible, instead of pivoting around an "elbow", or mixed forms (not shown).

In this embodiment, the organisers are imaginary lines on the cylinders (or cylinder-like structures, such as cylinder polygons), on the outer surface of the cylinders, extending substantially parallel to the cylinder's longitudinal axis.

Figure 15:
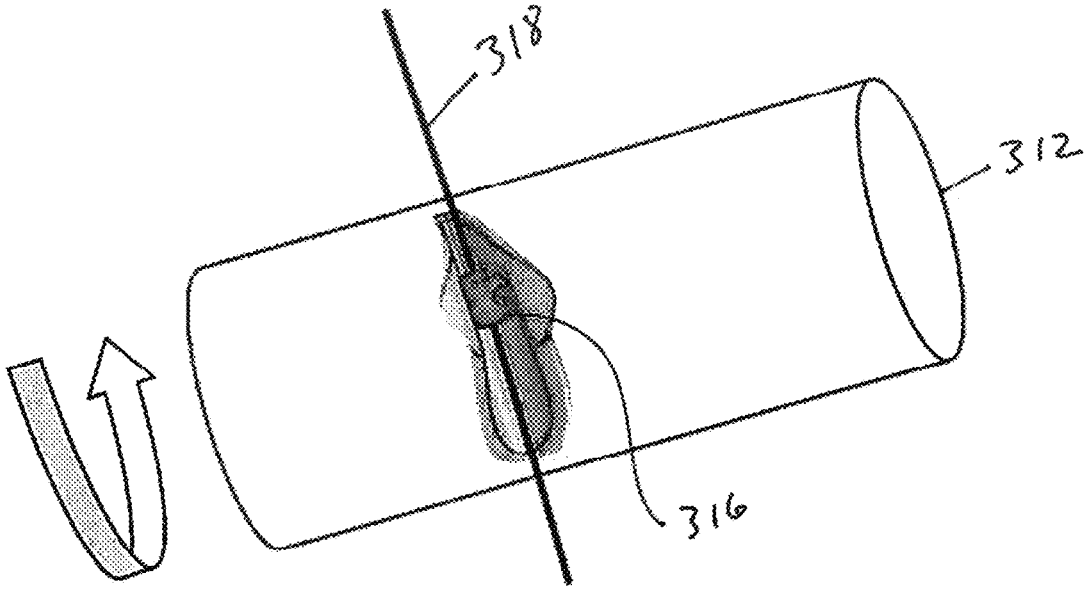
FIGS. 15 to 17 are schematics of the cylinder and catch mechanism of the fourth embodiment depicted in FIGS. 13 and 14, in accordance with the invention.
Figure 16:
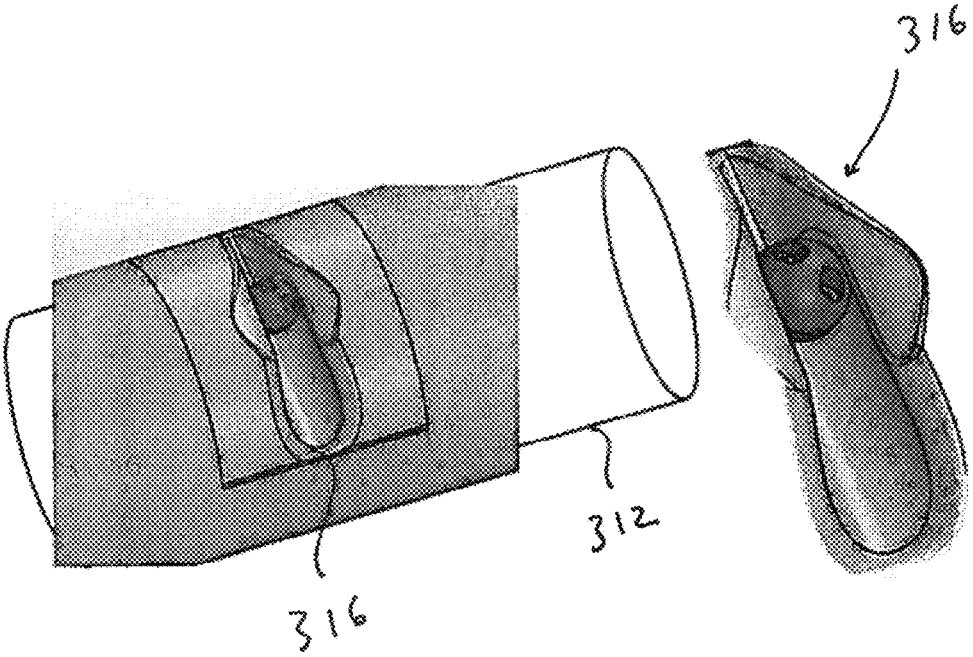

Cylinders 312.1 and 312.2 can further be equipped with a hook or a catch device 316, see FIGS. 15 and 16, which can catch and hold the kite connecting lines 318 or bridles, or a defined point on the these. This point can for instance be a thickening of the lines/bridles 318 or a ball mounted on the line/bridle 318, which the catch device 316 can catch to form a temporary firm connection, see FIG. 15.

Again, the kite connecting line 318 can be supported by a frame type element 16.4 as depicted in FIG. 1.

The catch device can take the form of a hook (not shown) or in form of a slot or groove 316, configured to catch e.g. a thickening of the lines/bridles (not shown) or a ball mounted on the line/bridle 318, to form a temporary firm connection.

There may be several of the catch devices located on the cylinder 312.1 and 312.2, for redundancy and/or to catch more than two kite connecting lines 318.

The catch devices 316 can be equipped with actuators, to actively lock a line or bridle 318 into the device, and/or to lock the thickening or ball into the device. The connection(s) or lock(s) can be actively locked or opened by means of these actuators (not shown). The locking system can be remotely controlled.

The catch devices can also be equipped with sensors, sensing presence of the ball or thickening of a line.

Figure 17:
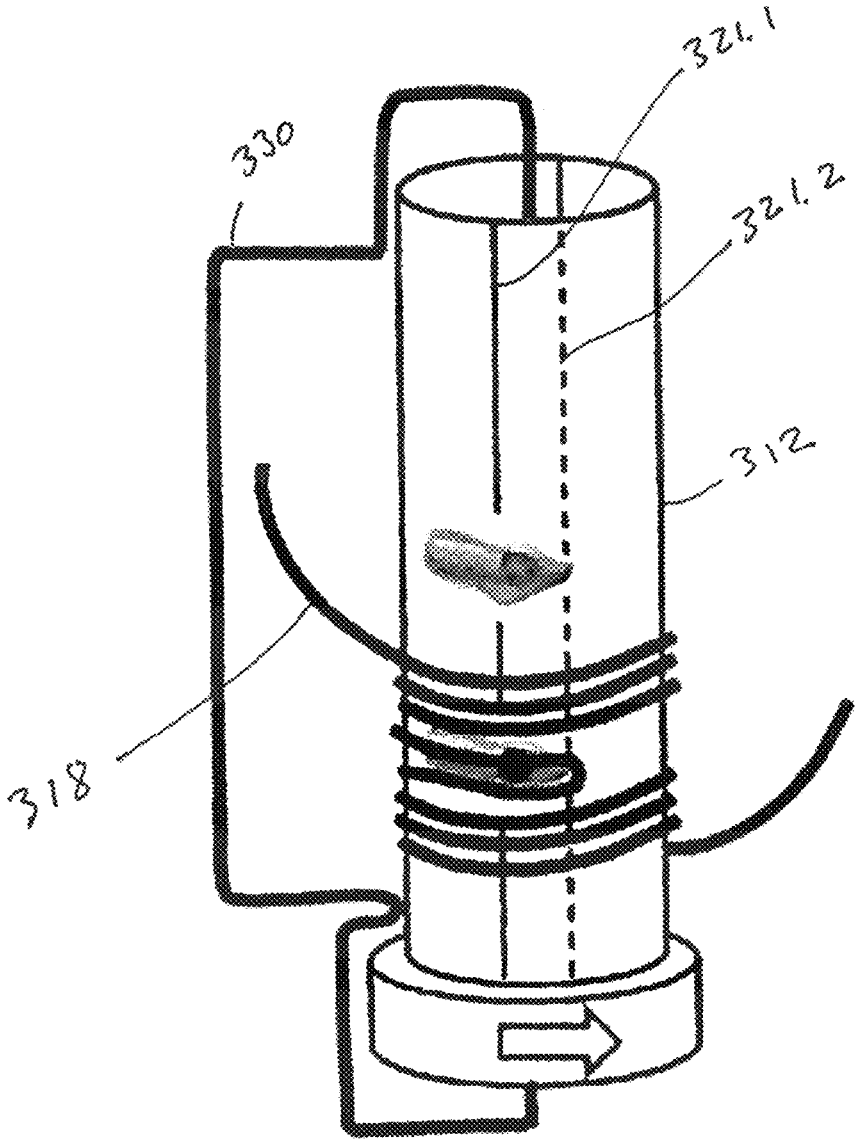

FIG. 17 is a bottom view. It depicts the reefing frame 330, which may be arranged around rotating organisers, in this embodiment imaginary lines 321.1 and 321.2 on the surface of a cylinder-like structure 312. The rotating organisers will bend or deflect or redirect the kite connecting lines, to keep them straightened or stretched out and under tension. The reefing frame itself is usually not rotating, and the kite connecting line(s) 318 leading towards the kite are guided through the frame. The reefing frame can be integrated around the rotating organiser, as shown, or it can be separate, like an oval-shaped ring or rectangular shape above the organiser, towards the kite.

When the organisers 321.1 and 321.2 rotate around one another, they will wind up the kite connecting line(s), and the portions towards the kite are forced through the reefing frame. This facilitates that the line(s) or bridles do not fall off the organiser(s). It also has the technical effect that the organiser(s), in this instance cylinder(s), can be shorter, relative the size of the kite, which may have a longer chord than the length of the cylinders. This allows to launch or land large kites with relatively short organisers.

Advantages of the Invention

By applying the invention, the inventor believes that one can launch or land large kites in a process safe manner, in dimensions where the kites are much larger than with alternative systems. In particular, when applying the invention in its second, third or fourth embodiment, no large ground platform to lay up the kite before launch and after landing is required, because the lines and the kite can be wind up by the organizers. While doing this, the rotational displacement of the engagement formations or the organizers around each other does not twist the kite connecting lines or ropes, with the potential to damage these. Also, no high launch/land masts, as envisioned in prior art, are required, which limit the size of the kite, which can be safely launched or landed. This technical advantage also includes the first embodiment, next to the other embodiments of the invention.

The invention further allows to store a kite in a compact manner, while on the ground and not in use. It also allows to change kites at the kite control system efficiently, which are rolled-up in a magazine-like manner. This is particularly useful, when handling kites on board of a ship, and when changing kites on sea.

The invention claimed is:

1. A kite launch-land system comprising:

a base;

a kite control system located below or included in the base;

one or more kite connecting lines extending from the base for interconnecting a kite and the base; and an organizing arrangement arranged about the base for manipulating and/or organizing the one or more kite connecting lines during launch and/or land of the kite for effectively controlling the kite by inhibiting slack in the one or more kite connecting lines by straightening and/or stretching out and/or tensioning at least a portion of the one or more kite connecting lines, and by deflecting the one or more kite connecting lines at multiple locations along the one or more kite connecting lines, wherein deflecting the one or more kite connecting lines includes winding up said lines, wherein the organizing arrangement, when not in use for launch or landing, is configured to be movable into a position in which the organizing arrangement is spaced apart from the one or more kite connecting lines, such that the organizing arrangement does not touch the one or more kite connecting lines and therefore no forces are transmitted between the organizing arrangement and the one or more kite connecting lines.

2. The kite launch-land system as claimed in claim 1 which includes a second kite control system located in between the base and the kite.

3. The kite launch-land system as claimed in claim 1 wherein the organizing arrangement includes at least two organizers, wherein the organizers take the form of a frame-type element, and wherein the frame-type element is pivotally or slidably arranged about the base.

4. The kite launch-land system as claimed in claim 1 wherein the organizing arrangement includes a plurality of organizers, wherein at least one of the plurality of organizers takes the form of a set of engagement formations positioned opposed one another and whereby, when in use, twisting and/or rotation of the engagement formations results in straightening of or tensioning of or stretching out the one or more kite connecting lines.

5. The kite launch-land system as claimed in claim 4 wherein each of the set of engagement formations takes the form of a plurality of rods arranged in a spaced apart manner and mounted onto a rotatable arm.

6. The kite launch-land system as claimed in claim 4 wherein the engagement formations extend from an arm suspended pivotably for orienting the sets of engagement formation towards and away from one another, respectively.

7. The kite launch-land system as claimed in claim 1 wherein the organizing arrangement includes one or more sets of organizers, operable dependently from one another in a rotatory movement within a respective set.

8. The kite launch-land system as claimed in claim 1 wherein the organizing arrangement takes the form of a plurality of organizers, which plurality of organizers are displaceable by lateral and/or translational and/or transversal displacement of one organizer relative to another for organizing and/or manipulating and/or controlling of the one or more kite connecting lines.

9. The kite launch-land system as claimed in claim 1 wherein the organizing arrangement includes a plurality of organizers for organizing the one or more kite connecting lines by rotation of at least one of the plurality of organizers.

10. The kite launch-land system as claimed in claim 1 wherein the organizing arrangement comprises at least one organizer for organizing the one or more kite connecting lines by rotation of the organizer in direction transversally a chord axis of the kite connected to the one or more kite connecting lines.

11. The kite launch-land system as claimed in claim 1 wherein the organizing arrangement comprises at least one organizer for organizing the one or more kite connecting lines by rotation of the at least one organizer in direction substantially parallel a chord direction of the kite connected to the one or more kite connecting lines.

12. The kite launch-land system as claimed in claim 1 wherein the organizing arrangement takes the form of one or more rotatable cylinders for winding up and release of at least a portion of the one or more kite connecting lines.

13. The kite launch-land system as claimed in claim 12 wherein the cylinder includes a catch mechanism configured for operatively engaging the cylinder with a portion of the one or more kite connecting lines.

14. The kite launch-land system as claimed in claim 1 wherein the organizing arrangement takes the form of one or more rotatable shapes, such as a beam, rod(s), pole(s), a polygon pole, or a square bar, or a triangular-shaped bar, or a two/multi-rods decoiler, for winding up and release of at least a portion of the one or more kite connecting lines.

15. The kite launch-land system as claimed in claim 1 wherein the organizing arrangement takes the form of a plurality of organizers and wherein each of the organizers comprising the plurality of organizers rotate at differential speeds relative one another to control the flight of the kite during launch and/or landing.

16. The kite launch-land system as claimed in claim 1 wherein the organizing arrangement takes the form of a plurality of rotatable organizers wherein the rotatable organizers are configured to wind up bridles or kite connecting lines extending from the kite canopy, while at the same time rolling in the bridles or kite connecting lines extending from the kite control system, while the kite control system roll out the kite connecting line(s) or bridles concurrently and at a corresponding rate.

17. The kite launch-land system as claimed in claim 1 wherein the organizing arrangement includes a plurality of arms displaceably arranged relative one another.

18. The kite launch-land system as claimed in claim 1 wherein the organizing arrangement includes a plurality of arms, and organizers connected to distal end regions of each of the arms, the arms being configured to displace the organizers into engagement with the one or more kite connecting lines during launch and/or landing, and away from the kite connecting lines when disengaged therefrom.

19. The kite launch-land system as claimed in claim 1 wherein the organizing arrangement takes the form of a plurality of organizers, at least one of which include a catch mechanism configured for operatively engaging the organizer with a portion of the one or more kite connecting lines.

20. The kite launch-land system as claimed in claim 1 wherein the organizing arrangement includes one or more reefing frames, arranged around organizers, to reef the one or more kite connecting lines and/or the kite.

* * * * *